US006169358B1

(12) United States Patent
Jones et al.

(10) Patent No.: US 6,169,358 B1
(45) Date of Patent: Jan. 2, 2001

(54) METHOD AND APPARATUS FOR FLASHOVER CONTROL, INCLUDING A HIGH VOLTAGE SPACER FOR PARALLEL PLATE ELECTRON BEAM ARRAY DEVICES AND METHOD OF MAKING THEREOF

(75) Inventors: Gary W. Jones, Lagrangeville; Steven M. Zimmerman, Pleasant Valley, both of NY (US)

(73) Assignee: eMAGIN Corporation, Hopewell Junction, NY (US)

( * ) Notice: Under 35 U.S.C. 154(b), the term of this patent shall be extended for 0 days.

(21) Appl. No.: 09/073,342

(22) Filed: May 6, 1998

Related U.S. Application Data

(60) Provisional application No. 60/052,228, filed on Jul. 11, 1997.

(51) Int. Cl.[7] ..... H01J 1/62

(52) U.S. Cl. ..... 313/495; 313/496; 313/497

(58) Field of Search ..... 313/495, 496, 313/497, 51, 318.12, 318.01, 332

(56) References Cited

U.S. PATENT DOCUMENTS 5,223,766 6/1993 Nakayama et al. .
5,448,132 9/1995 Komatsu .
5,448,133 9/1995 Ise .
5,498,925 3/1996 Bell et al. .
5,534,743 7/1996 Jones et al. .
5,541,473 7/1996 Duboc, Jr. et al. .
5,561,339 10/1996 Jones et al. .
5,844,360 * 12/1998 Jeong et al. ..... 313/495
5,916,396 * 6/1999 Schmid et al. ..... 313/495

* cited by examiner

*Primary Examiner*—Ashok Patel
*Assistant Examiner*—Karabi Guharay
(74) *Attorney, Agent, or Firm*—David R. Yohannan; Collier Shannon Scott, PLLC

(57) ABSTRACT

A structure to reduce the likelihood of flashover in a parallel plate electron beam array is disclosed. The structure may comprise a means for generating a low intensity electric field in the vicinity of a spacer separating the parallel plates of the array, and the anode. The presence of the electric field in the vicinity of the spacer is not conducive to the occurrence of a surface supported flashover on the gates and emitters. The electric field means may be provided by a conductive coating on one or more surfaces of the spacer. Alternatively, the electric field means may be provided by a conductive coating on a guard ring located within the array in the vicinity of the spacer. Methods of making the structure are also disclosed.

3 Claims, 3 Drawing Sheets

METHOD AND APPARATUS FOR FLASHOVER CONTROL, INCLUDING A HIGH VOLTAGE SPACER FOR PARALLEL PLATE ELECTRON BEAM ARRAY DEVICES AND METHOD OF MAKING THEREOF

RELATED APPLICATIONS

This application is related to and claims priority on U.S. Provisional Patent Application Serial No. 60/052,228, filed Jul. 11, 1997.

In connection with the present application for patent, Applicants hereby claim the priority of a prior filed, co-pending provisional application, Serial No. (unassigned), filed on Jul. 11, 1997 and having the above-referenced title.

FIELD OF THE INVENTION

The present invention relates to insulative spacers provided between parallel plates between which there is an electric potential. The insulative spacers of the invention may reduce the likelihood of surface electron flashover between the parallel plates.

BACKGROUND OF THE INVENTION

Electron beam emitting arrays are known. Presently, such arrays are being provided in the form of microminiature field emitters, which are known in the microelectronics art. These microminiature field emitters are finding widespread use as electron sources in microelectronic devices. For example, field emitters may be used as electron sources in flat panel displays for use in aviation, automobiles, workstations, laptops, head wearable displays, heads up displays, outdoor signage, or practically any application for a screen which conveys information through light emission. Field emitters, as well as other types of electron beam arrays, may also be used in non-display applications such as power supplies, printers, and X-ray sensors.

Referring to FIG. 1, the cross-section of a parallel plate type electron beam emission device 10 is shown. The device includes a lower plate 100, a spacer structure 200, and an upper plate 300. The lower plate 100 may comprise a substrate 110 and a conductive element 120. The lower plate 100 may include additional elements in the interior of the device 10, which are useful for emitting electrons in the direction of the upper plate 300. The upper plate 300 may comprise a substrate 310 and a conductive element 320. The upper and lower plates may be connected along their respective outer edge regions with the spacer structure 200. The spacer structure 200 may itself comprise an insulator frame or ring 210 bonded to the upper and lower plates with an upper glass frit 220 and a lower glass frit 230, respectively.

In order to achieve a beam of electrons, from the lower plate 100 to the upper plate 300, of a predetermined velocity, the upper conductive element 320 may be maintained at a high positive voltage relative to the source of electrons located on the lower plate 100. Thus the upper conductive element 320 may also be referred to as an anode. If the device 10 is a display, the anode 320 may be replaced by a thin transparent conductive layer. A layer of phosphor (not shown) may be provided on the interior region of the plate 300 over the anode 320. Electrons attracted to the anode 320 strike the phosphors, causing them to luminesce, and light emitted through the top side 312 of the support 310 may be viewed as part of an image, text, etc.

In order to operate the device 10, the space between the lower plate 100 and the upper plate 300 should be evacuated.

Typically, this space may be of the order of 0.5 to 5 millimeters. To maintain the vacuum between the upper and lower plates, they are sealed to one another along their respective edges by the spacer structure 200. After being sealed, the space between the two plates, 100 and 300, may be evacuated of air or gas and sealed off from the outside atmosphere.

Because the materials within the device 10 (such as phosphors) are very likely to outgas over time, a getter (not shown) may be provided within the evacuated space or in communication therewith. The getter is a substance which may absorb gas molecules that come in contact with it as a result of outgassing from materials within the device.

It is imperative to the operation of the device to capture as many of the outgassed gas molecules as possible. The reason being that these gas molecules may become ionized as a result of being bombarded by the electrons in the device. If the gas pressure is high enough, there will be a growth in the ionization leading to a gas-discharge (breakdown flashover) between the anode 320 and the elements of the lower plate 100. In devices in which the potential between the anode 320 and the lower plate 100 is in the range of thousands of volts, such flashover may be catastrophic to the device 10. Even if the flashover is not initially catastrophic, flashover may result in vaporization of materials within the device, resulting in the production of additional gas molecules therein, and sowing the seeds for a future flashover. The flashover problem is particularly noticeable during the bum-in of new displays. Burn-in is carried out by operating a display at anode voltages well above those that would be experienced by the display during normal operation. It is at this time that displays are particularly susceptible to flashover.

Any residual outgassing as a result of electron bombardment of phosphor, and the gates to a smaller extent, would result in the gas molecules flowing towards the sidewalls (spacer and frit) and the getter material. The occurrence of gas flow towards the getter is referred to as getter pumping. Because the absorption of gas molecules on the sidewalls is slow, the density of gas molecules close to the wall tends to be high on a short time scale. If the product (p)(d) of the local gas pressure (p) in the vicinity of the walls and the distance (d) between the anode and the gate is sufficient for a pachen breakdown, then a cumulative ionization leading to a gas discharge (flashover) will occur between the anode and the gate. The flashover between the anode and the gate can trigger a flashover between that gate and corresponding emitters. For this reason most flashovers take place close to the sidewalls in a field emission display.

Prior to the present invention, adequate flashover control has been virtually nonexistent. The primary method of combating flashover has been to reduce the operating potential between the anode 320 and the elements of the lower plate 100. By decreasing the potential to levels of only a few hundred volts, the occurrence of flashover may be reduced, although it is far from eliminated. This reduction in the potential, however, has serious repercussions on the longevity of the display. In a display, most phosphor degradation occurs in proportion to the total number of electrons having struck the phosphor, and not in proportion to the total power or light output of the phosphor. High anode voltages, in excess of 5,000 volts, permit aluminized phosphor films to be used, which increase efficiency and reduce the rate of fixed patterns being burned into the phosphor screen.

Ise, U.S. Pat. No. 5,448,133 (issued Sep. 5, 1995) for a Flat Panel Field Emission Display Device with a Reflective Layer, touts the advantages of reducing the potential between the anode and cathode in a Field Emitter Display (FED). Ise states that a reduction of the operating voltage of a FED will reduce power consumption, which reduces battery size, and enables portability. Ise states that presently the low end threshold for anode to cathode potential is about 400 volts. Ise reports operation of his FED at as low as 100 volts of cathode to anode potential.

Reduction of the lower plate to anode potential, as suggested by Ise, may reduce FED lifespan. Lifespan may be reduced because the luminous efficiency of the FED phosphors depends on the coulomb charge per unit volume applied to the phosphors over a period of time. The application of charge to the phosphors seems to dislocate activators from their sites in the phosphor host lattice, and thus decreases the activator excitation efficiency (by increasing the vacancy density). A phosphor layer of certain thickness, if operated by high voltage and low current, tends to have low values of coulomb per unit volume due to the increased penetration depth of the charge delivering electrons. On the other hand, if the same layer is operated with low voltage and high current (maintaining the same power) the coulomb per unit volume increases due to the decreased penetration of the electrons (charge concentration at the surface of the layer). Increased coulomb per unit volume resulting from low voltage operation is more detrimental to the activators than high voltage operation over a given time span. Consequently the luminous efficiency decreases more rapidly for low voltage FEDS. A decrease in light output may also occur in low voltage FEDS due to the intervening passive thickness of the phosphor layer between the observer and the active surface layer.

In a different approach, Applicants achieved some level of flashover control using the field emitter arrays disclosed in Jones, U.S. Pat. No. 5,534,743 (Jul. 9, 1996) for Field Emission Display Devices, and Field Emission Electron Beam Source and Isolation Structure Components Therefor, which is incorporated herein by reference in its entirety. The field emitter arrays disclosed in the '743 patent may include one or more thin layers of insulator material overlying the gate rows to protect against flashover and partially deflect electrons. The thin insulator layers disclosed in the '743 patent are very helpful to the control of flashover, however, the provision of such insulator layers does not completely solve the flashover problem, and also cannot be provided at zero cost.

In still another approach, which is particularly applicable to large screen FEDS, Nakayama et al. disclose an FED having a cathode panel and a back panel with space therebetween in U.S. Pat. No. 5,223,766, Nakayama et al. (Jun. 29, 1993) for an Image Display Device with Cathode Panel and Gas Absorbing Getters. In Nakayama, through holes may be provided in the cathode panel, and the space between the cathode and back panels may be used for containing getters. The inventors in Nakayama state that it is an object of the invention to provide a display device capable of containing a sufficient amount of getter for maintaining a required pressure, wherein the image quality can be maintained at the center of a display screen so that a superior image quality is attainable, even on a large-sized screen. Therefore, in Nakayama, additional getter is provided in the FED so that the pressure within the FED may be higher than it would otherwise have to be to minimize flashover. The increased residual gas pressure, that is acceptable to Nakayama et al., may result in unacceptable levels of flashover despite the additional getter material used.

The problems associated with sidewall induced flashovers, discussed above, may also arise in the interior portions of large sized screen FEDS when low internal device pressure is maintained. Internal spacers are commonly used to maintain low (vacuum) pressure within an FED. Internal spacers prevent the FED screen from bowing inward as a result of the vacuum conditions of the FED interior. While the spacers beneficially keep the screen from bowing or breaking, the spacers also provide a surface linking the gate and anode which can facilitate flashovers.

Accordingly, there is a need for new methods and apparatus for reducing the occurrence of flashover, without reducing the level of anode voltages. There is also a need for methods and apparatus for reducing the magnitude of damage suffered from the occurrence of flashovers during the initial burn-in and operation of the device. There is a particular need for a device which does not support surface flashovers along the interior surfaces and/or internal spacers of the device. The present invention meets this need, and provides other benefits as well.

OBJECTS OF THE INVENTION

It is therefore an object of the present invention to provide methods and apparatus for reducing the occurrence of flashovers in parallel plate electron beam arrays.

It is another object of the present invention to provide methods and apparatus for reducing the amount of damage suffered from the occurrence of flashovers in parallel plate electron beam arrays.

It is a further object of the present invention to provide methods and apparatus for reducing the occurrence of flashovers which are supported by spacers in parallel plate electron beam arrays.

It is yet another object of the present invention to provide a means for providing a low intensity electric field in the vicinity of a spacer in a parallel plate electron beam array.

It is still yet another object of the present invention to provide methods and apparatus for increasing anode voltages in a parallel plate electron beam array without increasing the occurrence of flashovers in the array.

It is still a further object of the present invention to provide methods and apparatus for reducing the occurrence of flashovers in parallel plate electron beam arrays by absorbing residual gas therein.

Additional objects and advantages of the invention are set forth, in part, in the description which follows and, in part, will be apparent to one of ordinary skill in the art from the description and/or from the practice of the invention.

SUMMARY OF THE INVENTION

In response to the foregoing challenge, Applicants have developed an innovative, economical electron beam array device comprising: a lower plate and an upper plate connected along an outer perimeter by a continuous spacer structure; and means for providing a low intensity electric field region along at least one surface of said spacer structure.

Applicants have also developed an innovative and economical method of making an electron beam array device comprising the steps of: providing a lower plate, an upper plate, and a glass plate; removing a selective portion of said glass plate to form a glass frame; providing a conductive coating on a surface of said glass frame; and sealing said glass frame between said lower plate and said upper plate.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention, and together with the detailed description serve to explain the principles of the present invention.

DETAILED DESCRIPTION OF THE PREFERRED EMBODIMENTS

Figure 1:
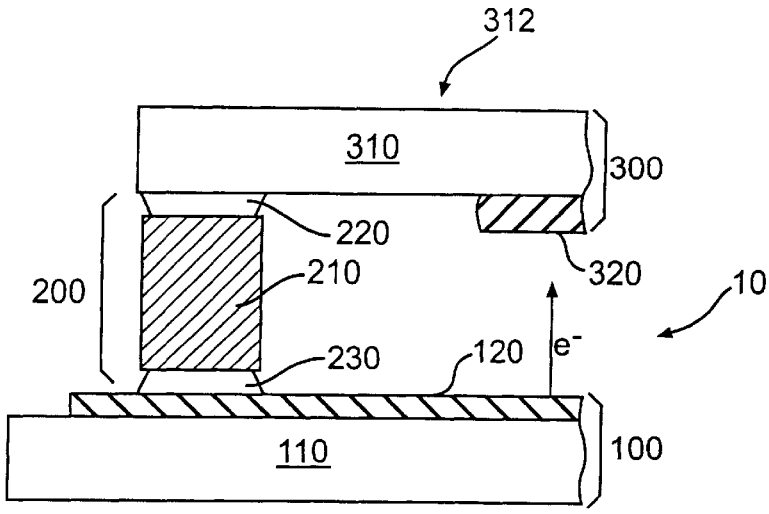
FIG. 1 (PRIOR ART)
FIG. 1 is a cross-sectional view in elevation of a known type of electron beam array device.
Figure 2:
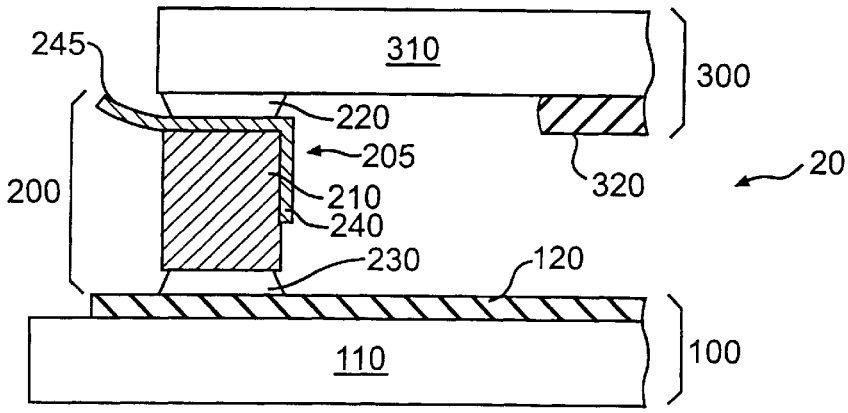
FIG. 2 is a cross-sectional view in elevation of the edge region of a first electron-beam array embodiment of the invention.

Reference will now be made in detail to a preferred embodiment of the present invention, an example of which is illustrated in the accompanying drawings. A preferred embodiment of the present invention is shown in FIG. 2 as the edge portion of device 20. Device 20 may be any parallel plate electron beam array, including a field emitter display.

Device 20 comprises a lower plate 100, an upper plate 300, and a spacer structure 200. The spacer structure 200 includes a means for providing a low intensity electric field 205 along at least one surface of the spacer structure. The electric field means 205 may comprise a conductive coating 240, of material such as chromium, nickel, gold, silver platinum, chromium oxide, amorphous diamond, or diamond like films on a surface of an insulator frame or ring 210. The presence of the conductive coating 240 may generate a low intensity electric field in the vicinity of the insulator frame 210. This electric field region does not readily support an electron flashover over the surface of the insulator frame 210. When the conductive coating is maintained at a certain potential (typically zero) there exists a field between the anode 320 and the conductive coating 240. As described earlier, the residual gas molecules released as a result of electron bombardment of phosphor will immediately tend to flow towards the perimeter of the device. Before the equilibrium pressure is reached, there is likelihood of the build-up of local pressure at the regions of the sidewall (i.e., spacer and frit). In the absence of the coating 240, the electric field existing between the anode 320 and one of the elements of plate 100 will cause a gas discharge breakdown flashover) if the pressure and the spacing between the anode and one of the elements of plate 100, are appropriate for a pachen breakdown criterion. This breakdown will ruin the gate and emitter elements of plate 100. This destructive flashover can be prevented if there is an electric field between the anode and conductive coating 240. This field will take over the breakdown of the gas and thus prevent the flashover on the vital elements of plate 100. The coating 240 and its potential close to zero acts similar to the "lightning arrester" of a building.

Figure 4:
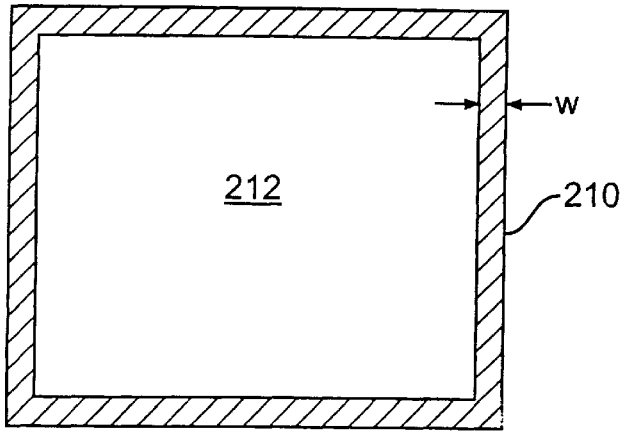
FIG. 4 is a plan view of an exemplary insulator frame employed in the invention.

In a preferred embodiment of the invention, device 20 may be constructed in the following manner. The insulator frame 210 (or guard ring 250 in FIG. 5 discussed below) may first be formed from a sheet of insulative material, such as glass. The frame 210 may be formed by trimming the glass sheet so that the outer dimension of the glass sheet is approximately the same as the outer dimension of the upper plate 300. With reference to FIG. 4, an interior portion of the frame 210 may be removed by cutting or any other process. Thus the frame 210 may be formed with wall widths (w) in the range of 1 to 8 millimeters for average sized devices 20. Larger or smaller devices, however, may be provided with frames having larger or smaller wall widths.

With renewed reference to FIG. 2, the frame 210 may next be cleaned by the application of a wash of 3% hydrofluoric acid followed by the application of de-ionized water. Following cleaning, a coating of conductive material 240 may be deposited on one or more surfaces of the frame 210. Preferably, the frame 210 may be sputter coated so that the upper surface of the frame is coated with a layer of chromium, nickel, gold, or some other suitable conductor. Examples of suitable thicknesses for the various conductors are a 100 to 150 nanometer thick coating of chromium or nickel, or a 30 to 100 nanometer thick coating of gold. Alternative coating techniques, such as electro-plating, electroless plating, or evaporation may also be used to deposit the coating of conductive material 240.

Figure 3A:
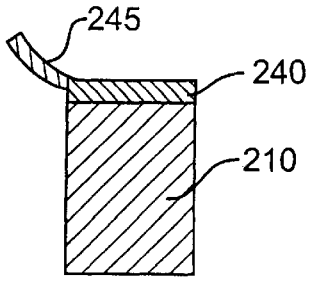
FIGS. 3A, 3B, and 3C are alternative embodiments of the spacer structure shown in FIG. 2.
Figure 3B:
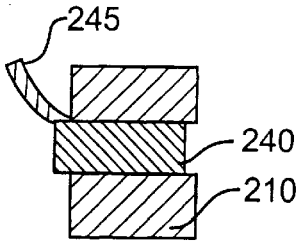
Figure 3C:
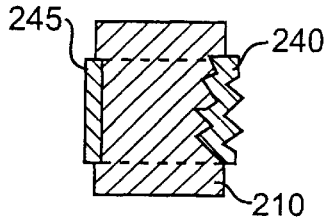

In alternative embodiments of the invention, one or more sides of the insulator frame 210 may be masked prior to the application of the conductive coating 240 to the frame. Alternative versions of the insulator frame 210 may accordingly have cross-sections similar to those shown in FIGS. 3A, 3B, and 3C. In the frame 210 shown in FIG. 3A, the conductive coating 240 is present primarily only on the upper surface of the frame. Alternatively, the conductive coating 240 could be present primarily only on the lower surface of the frame, or on both the upper and lower surfaces of the frame. In the frame 210 shown in FIG. 3B, the conductive coating 240 is present primarily only on the inside surface of the frame, and may preferably be recessed. The step of masking may be varied such that various portions of the frame 210 may be coated with conductive material in accordance with the particular electric field and flashover control requirements of particular devices 20. In the frame 210, shown in FIG. 3C, there is a corrugated structure at the side facing the inside of the device. This structure creates high field points for the flashover to occur effectively. However, it should be recognized that these high field points are not as sharp as the field emitters so that the high field points do not take over the electron emission function. The structure of FIG. 3 may be made by forming sidewall ridges to support the corrogated structure by etching or molding. Alternatively, a similarly profiled structure could be formed by stacking alternating layers of insulators and conductors (e.g. glass for insulators and nickle foil for conductors).

Following the deposit of the conductive coating 240 on the frame 210, a layer of insulative sealing material 230, such as frit glass, a ceramic frit, or a meltable glass rod, may be applied to the lower plate 100. The frit glass 230 protects and insulates the conductor element 120 from contact with the conductive coating 240. The frit glass 230 also seals the frame 210 to the lower plate 100. Next, a layer of insulating sealing material 220 may be applied to the upper surface of the frame 210, or the lower surface of the upper plate 310, and the upper plate-spacer structure-lower plate sandwich may be pressed together to form the device 20. The completed device 20 is sealed along its periphery such that the interior of the device may be evacuated and maintained in vacuum.

In a preferred embodiment of the invention, one or more of the foregoing steps may be carried out in an evacuated chamber, or in an inert atmosphere. By constructing the device 20 in a vacuum or inert atmosphere, the oxidation of the conductive coating 240 may be reduced, thereby enhancing the electric field generating capability of the conductive coating.

Figure 5:
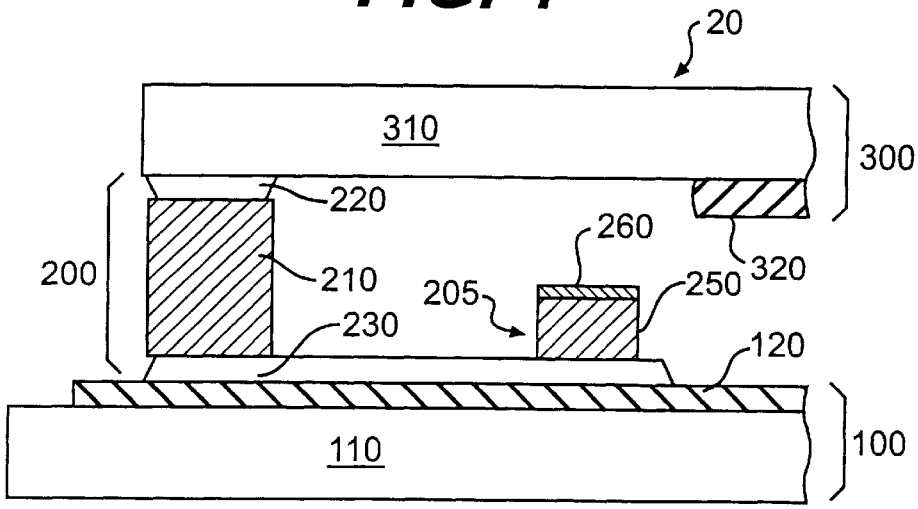
FIG. 5 is a cross-sectional view in elevation of the edge region of a second electron beam array embodiment of the invention.

With reference to FIG. 5, in which like reference numerals refer to like elements shown in the other figures, an alternative embodiment of the invention is shown. In the embodiment shown in FIG. 5 the electric field means 205 may not be provided by an insulator frame with a conductive coating. Instead, the electric field means 205 may be provided by an insulating guard ring 250 having a conductive coating 260. The insulating guard ring 250 and conductive coating 260 may be constructed in accordance with the foregoing explanation of the construction of the insulator frame 210 and the conductive coating 240.

After the conductive coating 260 is deposited on the guard ring 250, the guard ring may be connected to the lower plate 100 with a layer of insulative sealing material 230. The conductive coating 260 may be provided with a conductive tab 270 which connects the coating 260 with an externally applied electric potential. In the same manner, with reference to FIG. 2, the conductive coating 240 on the spacer may be provided with a conductive tab 245 connecting, the coating 240 to an electric potential.

The guard ring 250 may have an outer dimension which is smaller than that of the insulator frame 210. Thus, in order to connect both the guard ring 250 and the insulator frame 210 to the lower plate 100 with the sealing material 230, the sealing material must extend into the interior of the device 20 sufficiently that it is wide enough to accommodate both the insulator frame and the guard ring.

Figure 6:
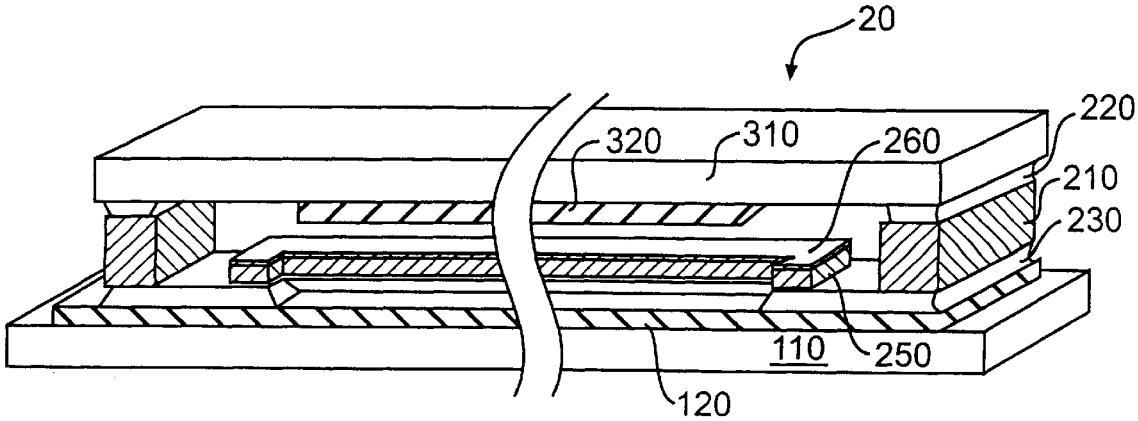
FIG. 6 is a combined cross-sectional view in elevation and pictorial view of the device shown in FIG. 5.

With continued reference to FIG. 5, the guard ring 250 with the conductive coating 260 provides a low intensity electric field in the vicinity of the edge portion of the device 20. The presence of this electric field reduces the likelihood of the occurrence of flashovers in the edge portion of the device. FIG. 6, in which like numerals refer to like elements shown in the other figures, shows a combined cross-sectional and pictorial view of the device 20 of FIG. 5.

Figure 7:
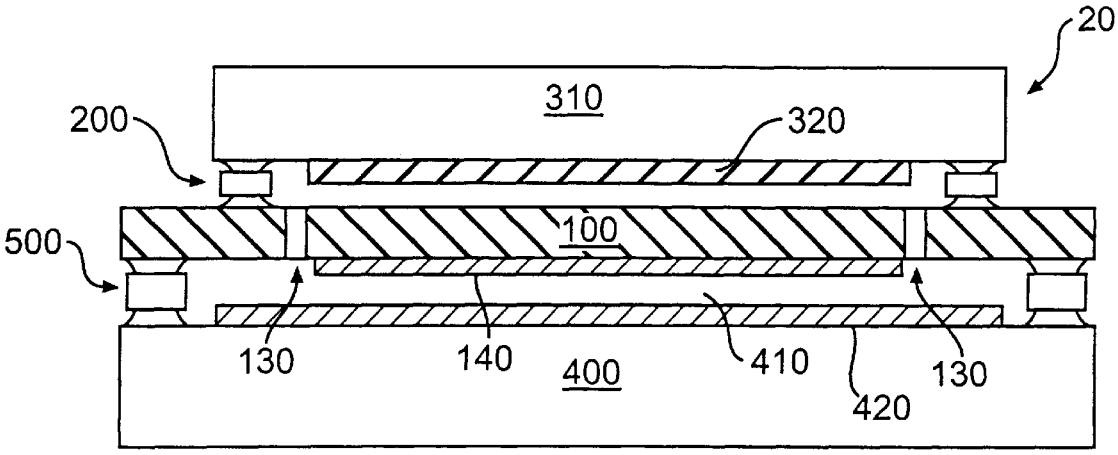
FIG. 7 is a cross-sectional view in elevation of a third electron beam array embodiment of the invention.

A third electron beam array embodiment of invention is shown in FIG. 7, in which like reference numerals refer to like elements shown in the other figures. The embodiment of FIG. 7 modifies the previously described embodiments of the invention by adding a space 410 below the lower plate 100 for the placement of getter material.

In FIG. 7, the lower plate 100 is sealed to a back plate 400 along the outer periphery of the lower and back plates. The lower plate 100 and back plate 400 may be sealed with a spacer structure 500 which is similar in design to the above described spacer structure 200. The lower plate 100 is sealed to the back plate 400 such that a space 410 is formed between the two plates. The seal between the plates may have sufficient integrity to permit a vacuum to be maintained in the space 410.

The undersurface of the lower plate may be coated with a layer of getter material 140. The upper surface of the back plate 400 may also be coated with a layer of getter material 420. The lower plate 100 may be provided with one or more through holes 130 which facilitate the migration of gas molecules between the space above the lower plate 100 and the space 410 below the lower plate 100. In this manner, gas molecules outgassed in the space above the lower plate 100 may migrate to and be captured by the layers of getter material 140 and 420.

The back plate 400 may be constructed of glass or another suitable support material. The back plate 400 may be sufficiently thick as to bear much, if not all, of the ambient pressure on the bottom of the device resulting from the interior of the device 20 being a vacuum. The upper plate 310 may also be sufficiently thick as to bear much, if not all, of the ambient pressure on the top of the device 20. In order for the upper plate 310 to bear all of the pressure on the top of the device 20, the upper plate 310 should be dimensioned such that the spacer structure 200 is substantially directly overlying the spacer structure 500. In this manner the lower plate 100 may be shielded from having to bear significant pressure forces, and accordingly may be made of thinner material than it otherwise might. With the use of a thick upper plate 310 and a thick back plate 400, large screen (25 to 40 inch diagonal) devices 20 may be constructed without the use of internal spacers in the devices.

Figure 8:
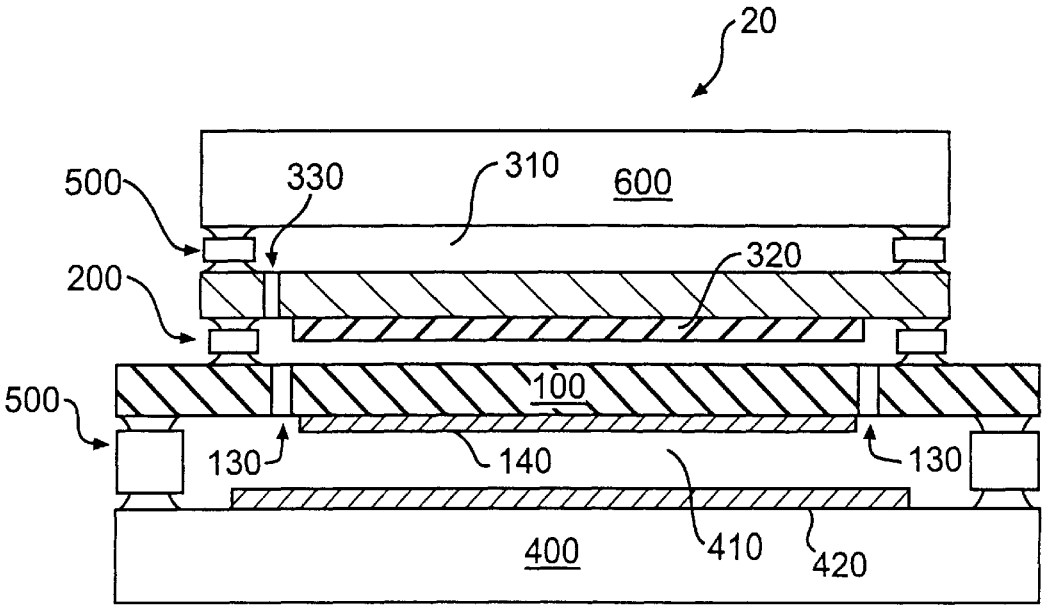
Fig 8 is a cross-sectional view in elevation of a fourth electron beam array embodiment of the invention.

A fourth electron beam array embodiment of invention is shown in FIG. 8, in which like reference numerals refer to like elements shown in the other figures. The embodiment shown in FIG. 8 is similar to that of FIG. 7, with the exception of the addition of a cover plate 600 and a thinner upper plate 310. In the FIG. 8 embodiment, a thick cover plate 600 of glass or other suitable material may be used to bear much, if not all, of the pressure on the top of the device 20. The cover plate 600 may be sealed to the upper plate 310 about the respective peripheries of the plates with a spacer structure 500. The upper plate 310 may be thinner than it otherwise might be because it is not required to withstand much, if any, of the pressure on the top or bottom of the device 20. The upper plate 310 may be provided with one or more through holes 330 which permit equalization of the vacuum condition in the interior spaces above and below the upper plate 310.

It will be apparent to those skilled in the art that various modifications and variations can be made in the construction, configuration, and/or operation of the present invention without departing from the scope or spirit of the invention. For example, in the embodiments mentioned above, various changes may be made to the sealing materials used to connect the insulator frame with the upper and lower plates of the device. Further, changes may be made to the order in which the upper and lower plates are sealed to the insulator frame, and to which of the elements (the frame or the plates) the sealing means is first applied. Changes may also be made to the shape, size, and wall width of the insulator frame (or guard ring) without departing from the scope or spirit of the invention. Further, it may be appropriate to make additional modifications or changes to the location of the conductive coating on the insulator frame in order to vary the effect and strength of the electric field means on a device by device basis. Thus, it is intended that the present invention cover the modifications and variations of the invention provided they come within the scope of the appended claims and their equivalents.

What is claimed is:

1. A field emitter display comprising:

an upper plate having an anode associated therewith;

a lower plate having an array of field emitters and gates associated therewith;

a spacer structure sealing said upper plate to said lower plate along outer perimeters thereof, said spacer structure comprising:

a insulator frame;

an upper glass frit connecting said insulator frame to said upper plate;

a lower glass frit connecting said insulator frame to said lower plate and having an extension extending into an interior region of said display;

a guard ring provided on said lower glass frit extension; and means for providing a low intensity electric field on said guard ring.

2. The field emitter display of claim 1 wherein said electric field means comprises a conductive coating on a surface of said guard ring and means for externally applying electric potential to said conductive coating.

3. The field emitter display of claim 2 wherein said conductive coating comprises a coating of chromium in the range of 1000 to 2000 angstroms thick.

* * * * *